United States Patent [19]

Ito

[11] 4,127,079

[45] Nov. 28, 1978

[54] SUPPORT DEVICE FOR SHIP-CARRIED INDEPENDENT TANK

[75] Inventor: Takanori Ito, Osaka, Japan

[73] Assignee: Hitachi Shipbuilding & Engineering Co., Ltd., Osaka, Japan

[21] Appl. No.: 867,354

[22] Filed: Jan. 5, 1978

Related U.S. Application Data

[62] Division of Ser. No. 763,005, Jan. 27, 1977, Pat. No. 4,086,864.

[30] Foreign Application Priority Data

Feb. 10, 1976 [JP] Japan ..... 51-13401
Feb. 10, 1976 [JP] Japan ..... 51-13402

[51] Int. Cl.[2] ..... B63B 25/08

[52] U.S. Cl. ..... 114/74 A; 114/74 R; 220/445

[58] Field of Search ..... 114/74 R, 74 A, 74 T, 114/256, 257; 248/DIG. 1; 220/435, 445, 439

[56] References Cited

U.S. PATENT DOCUMENTS 3,076,423 2/1963 Leathard ..... 114/74 A
3,339,782 9/1967 Seguva et al. ..... 220/448 X
3,842,775 11/1974 Edwards et al. ..... 114/74 R

*Primary Examiner*—Trygve M. Blix
*Assistant Examiner*—Sherman D. Basinger
*Attorney, Agent, or Firm*—Joseph W. Farley

[57] ABSTRACT

A support device for an independent tank, wherein a first support member secured to the tank is adapted to be supported on the top surface of a second support member attached to a ship's hold. Particularly in the case of a spherical tank, a horizontal ring projecting from adjacent the equator of the spherical tank is adapted to be supported on a support deck installed around the inner periphery of a ship's hold, with a pressure-resistant heat insulating material interposed between the ring and the support deck. In such support device, an anti-floating member is provided on and projects from either the first support member or the second support member through the other member without touching the same. When the tank tends to float up, the free end of the anti-floating member and the mating member engage each other with the pressure-resistant heat insulating material interposed therebetween, thereby preventing the floating up of the tank.

5 Claims, 14 Drawing Figures

SUPPORT DEVICE FOR SHIP-CARRIED INDEPENDENT TANK

This is a division of application Ser. No. 763,005 filed Jan. 27, 1977 now U.S. Pat. No. 4,086,864.

The present invention relates to a support device for a ship-carried independent tank and particularly to such support device having an anti-floating device for the tank.

In a low temperature liquefied gas carrying vessel, it is obligatory to install an anti-floating device in order to prevent great destruction of the tank which could occur when the tank floats up in the event of fracture of the hull. In the case of a spherical tank, for example, if a support system is employed in which the upper end of a support skirt upwardly projecting from the bottom of a hold is fixed to the tank, then there will be no problem since the system itself also performs the function of an anti-floating device. However, in a support system in which a horizontal ring projecting from the tank is supported on a support deck, some measures must be taken to prevent floating up. Further, in the case of a square tank, it is usual practice to support it by providing an anti-floating support block under the upper deck, in which case, however, it is necessary to reinforce the area of the tank corresponding to the support block. Such anti-floating device is provided for use in an emergency where the hull is broken and flooded. Normally, therefore, there is no force acting on said device. Thus, it should be as simple in construction and as light-weight as possible.

The principal object of the invention is to provide a support device for an independent tank, which is very simple in construction and light-weight and yet, in the event of the tank tending to float up, is capable of preventing such floating up and hence precluding great destruction of the tank. Such support device according to the invention comprises a first support member horizontally secured to the tank, a second support member secured to a ship's hold so as to support the tank by receiving said first support member thereon, an anti-floating member projecting from either said first or second support members and extending through the other support member without touching the same, and an engagement section formed on the free end of said anti-floating member so as to engage the mating member when the tank floats up. When the ship-carried independent tank is a spherical or cylindrical tank, said second support member comprises a support deck projecting from the inner periphery of the wall of a ship's hold while the first support member comprises a ring body horizontally projecting from the outer periphery of the tank. In the case of a square tank, said second support member comprises a bottom plate of the ship's hold and a receiving member fixed on the bottom plate so that said bottom plate and said engagement section engage each other while said first support member comprises the tank bottom plate itself, and said anti-floating member projects from the tank bottom plate. Usually, a pressure-resistant heat insulating material is interposed between the engagement surfaces of the engagement section of said anti-floating member and mating member to prevent transmission of heat to the hull and also to perform the function of a buffer when they engage each other.

Further, according to the arrangement of said support device, since the force which acts on the anti-floating member when the tank floats up is a simple tensile force, the anti-floating member need not have rigidity but may be simple and light-weight provided that it can withstand said tensile force. The invention provides a support device in which a band-like plate formed at its front end with an engagement surface perpendicular to the plate surface is used as said anti-floating member.

Further, the invention provides a support device for a spherical or cylindrical tank as described above, comprising suitably circumferentially spaced support chocks projecting from the lower surface of said ring body, anti-floating stands respectively disposed between said support chocks on the support deck and each having an anti-floating member extending from the upper end thereof, said support chocks having their lower surfaces and opposed lateral surfaces contacted with the support deck and the anti-floating stands through pressure-resistant heat insulating elements. According to such arrangement, since the anti-floating stands also serve as support blocks for preventing the horizontal movement of the tank, it is possible to simplify the construction, providing a most rational tank support device having anti-floating function.

Other numerous features and merits of the invention will be readily understood from the following description of various embodiments of the invention.

IN THE DRAWINGS

FIG. 1 is a front view, in transverse section, of a low temperature liquefied gas carrying vessel mounting a spherical tank;

FIG. 2 is a fragmentary sectional front view of the principal portions showing an anti-floating construction;

FIG. 3 is a fragmentary sectional side view of said principal portions;

FIG. 4 is a fragmentary sectional front view of the principal portions of a modification of said anti-floating construction;

FIG. 5 is a fragmentary sectional side view of said principal portions of said modification;

FIG. 6 is a front view, in transverse section, of a low temperature liquefied gas carrying vessel mounting a spherical tank;

FIG. 7 is a fragmentary sectional front view of the principal portions of a tank support device;

FIG. 8 is a fragmentary sectional side view of said principal portions;

FIG. 9 is a fragmentary sectional view of a modification of said tank support device;

FIG. 10 is a fragmentary sectional side view of said modification;

FIG. 11 is a front view, in transverse section, of a low temperature liquefied gas carrying vessel mounting a square tank;

FIG. 12 is a fragmentary side view, in longitudinal section, of said carrying vessel;

FIG. 13 is a fragmentary sectional side view of the principal portions of an anti-floating construction;

FIG. 14 is a fragmentary sectional front view of said principal portions.

Figure 1:
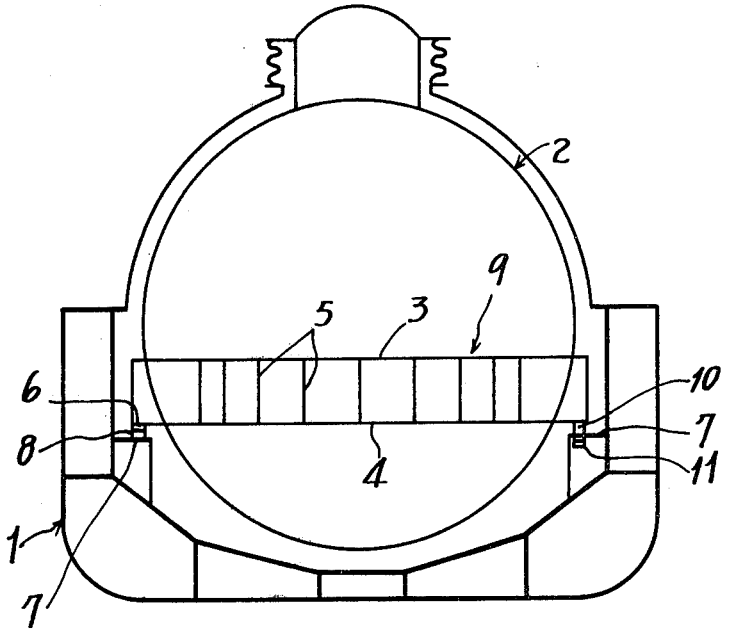
FIGS. 1 through 5 show a first embodiment.

A first embodiment of the invention will now be described with reference to FIGS. 1 through 5. Designated at 1 is a ship's hull, on which usually a plurality of spherical tanks 2 are mounted, such spherical tank being provided with a heat insulating device. Designated at 3 and 4 are upper and lower horizontal rings horizontally projecting from adjacent the equator of said spherical tank 2 and from a position therebelow, and the numeral 5 designates stiffeners interposed between said rings 3 and 4. These rings 3, 4 and stiffeners 5 constitute a ring body 9, which is a first support member. Designated at 6 are circumferentially equispaced support chocks attached to the lower surface of the ring 4. A support deck 7 which circumferentially extends above the bottom of the hold of the hull 1 and mounts the tanks 2 thereon constitutes a second support member for supporting said ring body 9 thereon. Attached to the upper surface of said support deck 7 are pressure-resistant support blocks 8 for supporting thereon said support chocks 6 with a suitable pressure-resistant heat insulating material interposed therebetween or without such pressure-resistant heat insulating material, in which case said pressure-resistant blocks 8 are made of a pressure-resistant heat insulating material. In addition, the support chocks 6 are supported on the pressure-resistant blocks 8 in such a manner as to be slidable thereon radially of the spherical tank 2.

Figure 2:
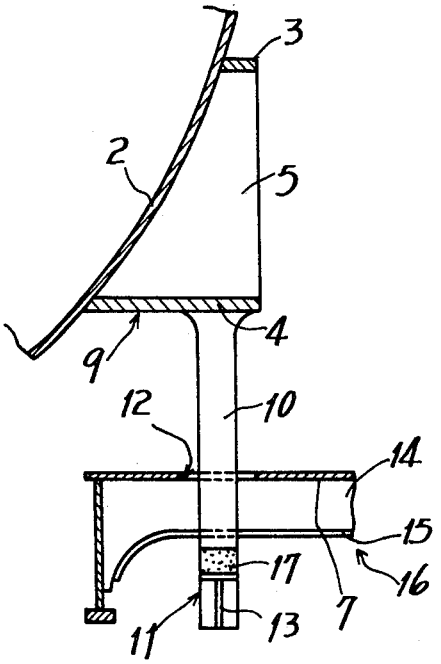
Figure 3:
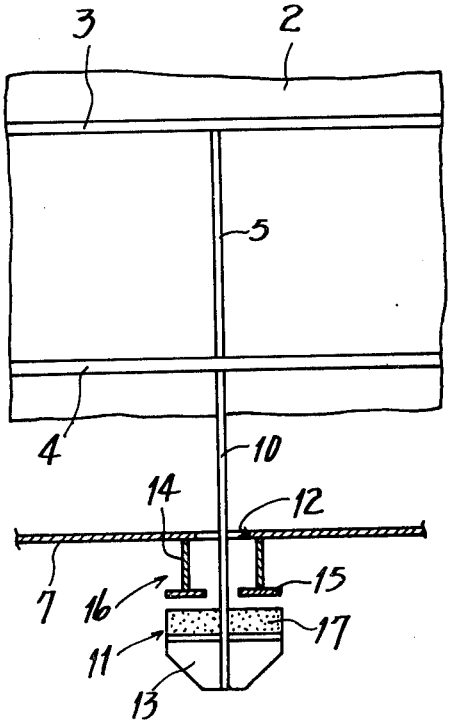

In the basic arrangement described above, an anti-floating member 10 is provided on and projects from the lower surface of the lower ring 4 through said support deck 7 without touching the latter. The free end of said anti-floating member 10 is formed with an engagement section 11 adapted to engage the lower surface of the support deck 7 when the tank tends to float up. More particularly, as shown in FIGS. 2 and 3, the anti-floating member 10 in the form of a band-like plate dependent from the lower surface of the lower ring 4, untouchedly extends through a through-hole 12 formed in the support deck 7, and a bracket 13 forming an engagement surface perpendicular to the plate surface is attached to the lower end of said anti-floating member 10, thereby constituting the engagement section 11. On the other hand, the lower surface of the support deck 7 is provided with a pair of rib members 14 on opposite sides of said through-hole 12, and the lower ends of said rib members 14 are provided with receiving plates 15 opposed to the engagement surface of said bracket 13. These rib members 14 and receiving plates 15 constitute a receiving member 16 consisting of a pair of inverted T-shaped members. Designated at 17 is a pressure-resistant heat insulating material attached to either said bracket 13 or rib plates 15 so that they will engage each other in a heat insulating condition when the tank tends to float up. Further, said material may have the function of a buffer. In addition, actually a plurality of said anti-floating members 10 are circumferentially disposed at positions clearing the support structures such as the support chocks 6.

Therefore, the spherical tank 2 is normally supported on the support deck 7 through the support chocks 6 and pessure-resistant support blocks 8, but said support deck 7 and anti-floating members 10 are in an untouched condition with respect to each other. When the spherical tank 2 tends to float up for one cause or another, the engagement sections 11 of the anti-floating members 10 which upwardly move along with the spherical tank 2 abut against the receiving plates 15 through the pressure-resistant heat insulating material 17, thereby preventing the tank from further floating up.

Figure 4:
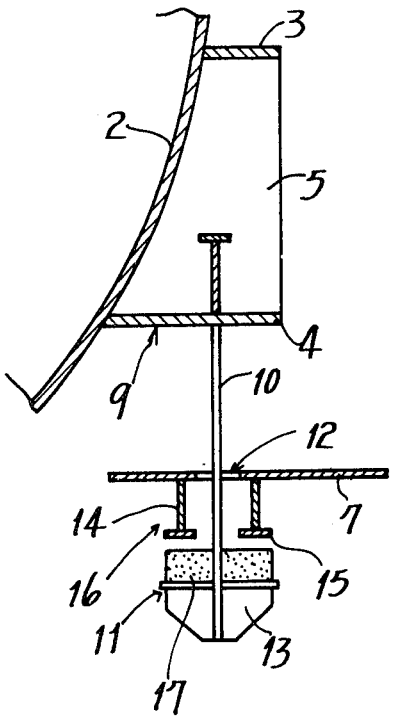
Figure 5:
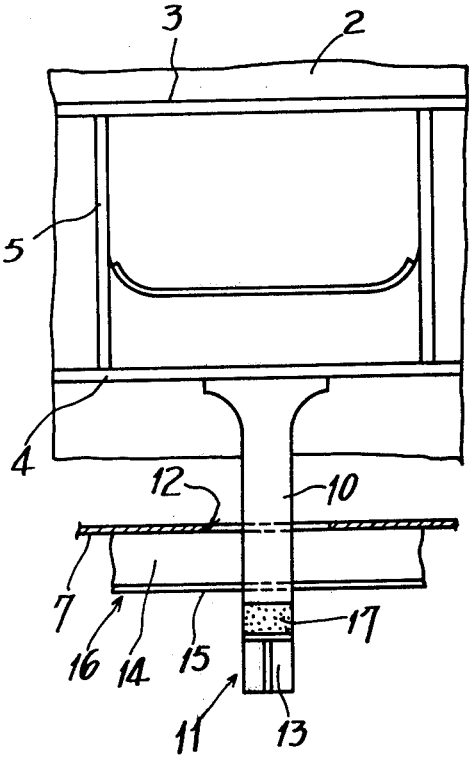
Figure 6:
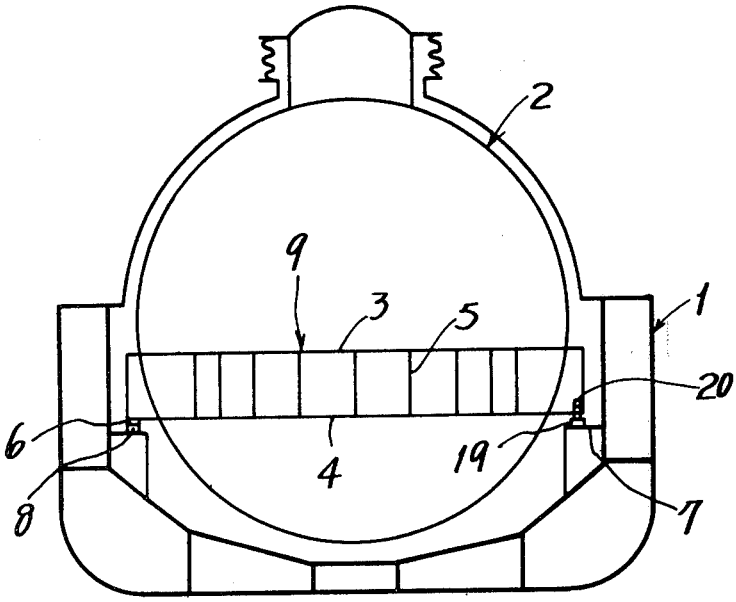
FIGS. 6 through 10 show a second embodiment of the invention.

Although an example in which the plate surfaces of the anti-floating members 10 are each formed of a band-like plate extending radially of the spherical tank 2 has been described with reference to FIGS. 2 and 3, they may be constructed so that their plate surfaces extend along the outer surface of the spherical tank 2, as shown in FIGS. 4 and 5.

Figure 7:
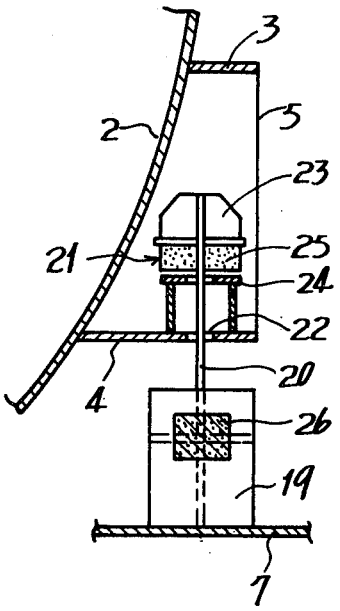
Figure 8:
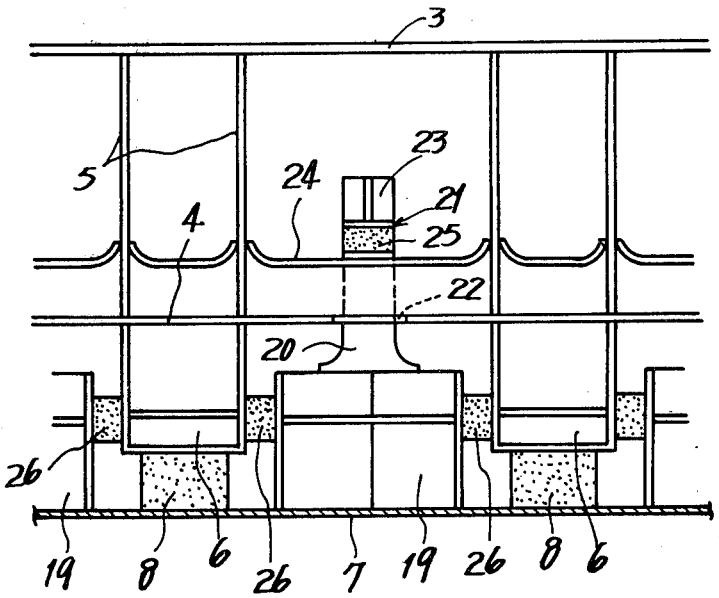

A second embodimen of the invention will now be described with reference to FIGS. 6 through 10. In addition, the same parts as those described in the first embodiment will be given like reference numerals and a description thereof will be omitted. According to this embodiment, in the basic support arrangement described above, anti-floating stands 19 are provided on the support deck 7 between said support chocks 6, and each anti-floating stand 19 is provided with an anti-floating member 20 upwardly projecting from the upper end thereof through said lower ring 4 without touching the latter, said anti-floating member 20 being formed at its upper end with an engagement section 21 so as to engage the upper surface of the lower ring 4 when the tank tends to float up. More particularly, as shown in FIGS. 7 and 8, the anti-floating stands 19 of rectangular shape fixed to the support deck 7 have the anti-floating members 20 formed of a band-like plate secured thereto at the middle and upwardly extending untouchedly through through-holes 22 in the lower ring 4, and brackets 23 which constitute the engagement sections 21 are attached to the free ends of the anti-floating members. Each bracket 23 has a pressure-resistant heat insulating element 25 attached to the lower surface thereof so as to be opposed to a rib-like receiving member 24 fixed to the lower ring 4. Further, each of said support chocks 6 has pressure-resistant elements 26 attached to opposite sides thereof for contacting to the sides of said anti-floating stands 19.

Figure 9:
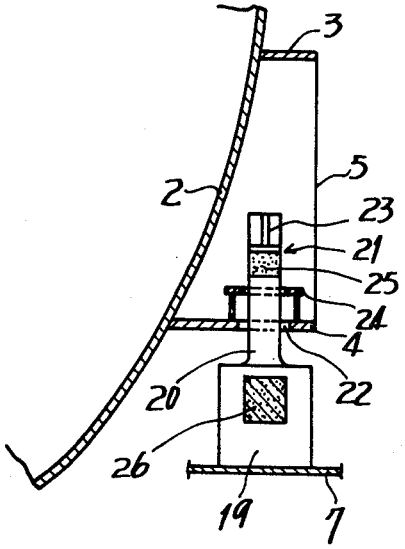
Figure 10:
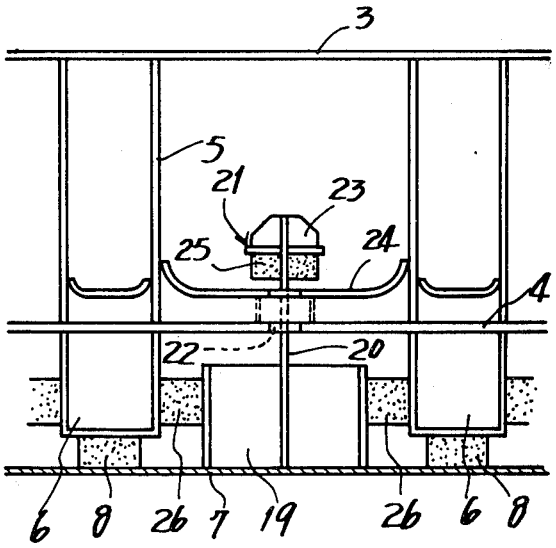
Figure 11:
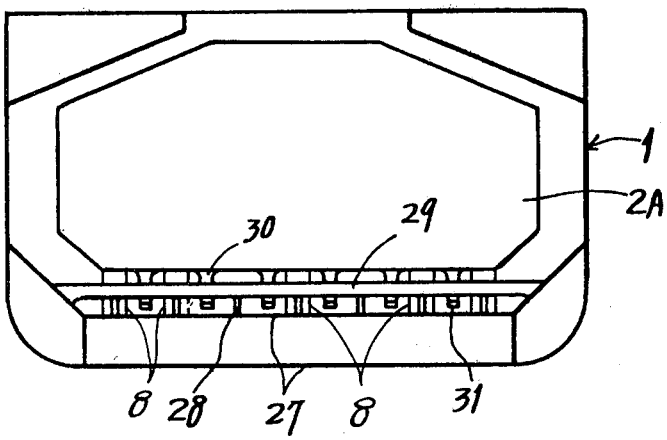
FIGS. 11 through 14 show a third embodiment of the invention.
Figure 12:
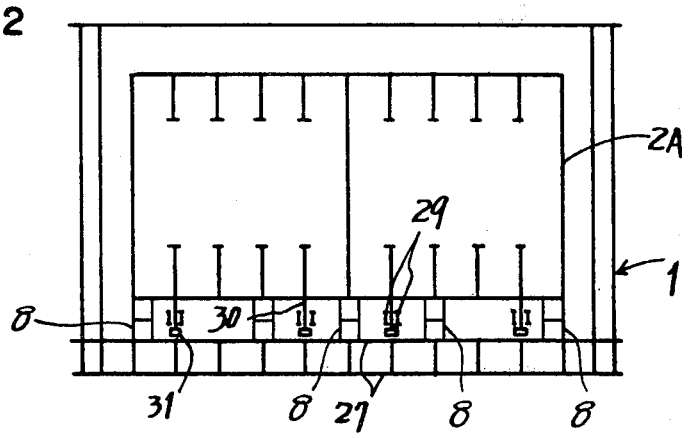
Figure 13:
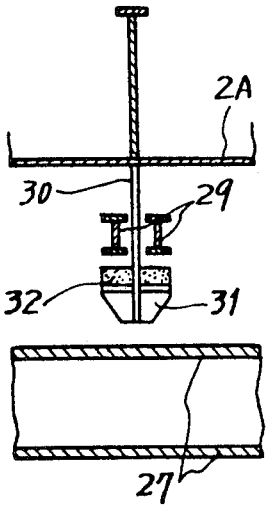
Figure 14:
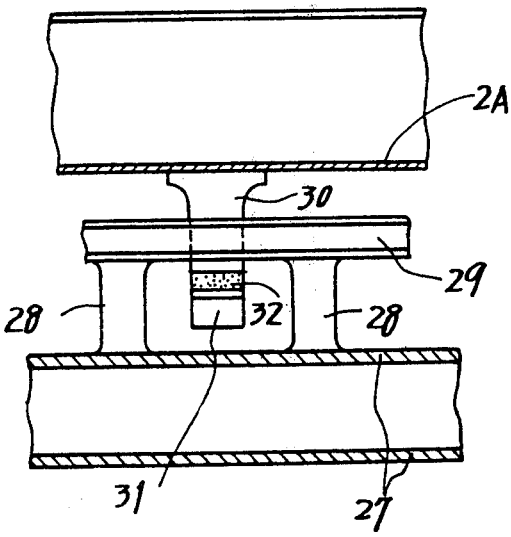

Although an example in which the plate surfaces of the anti-floating member 20 extend along the outer surface of the spherical tank 20 has been described with reference to FIGS. 7 and 8, the anti-floating members may be constructed so that their plate surfaces extend radially of the spherical tank 2, as shown in FIGS. 9 and 10. Further, the pressure-resistant heat insulating elements 25 may be attached to the upper surfaces of the receiving members 24.

Therefore, normally, the spherical tank 2 is supported on the support deck 7 through the support chocks 6 and pressure-resistant stands 8 while opposed sides of the support chocks 6 are contact-wise supported by sides of the anti-floating stands 19 through the pressure-resistant heat insulating elements 26, but the anti-floating members 20 and the lower ring 4 are in an untouched condition with respect to each other. When the spherical tank 2 tends to float up for one cause or another, the rib-like receiving members 24 of the lower ring 4 which upwardly move along with the spherical tank 2 are caught by the anti-floating members 20 integral with the support deck 7 through the pressure-resistant heat insulating elements 25, thereby preventing the tank from further floating up.

Finally, a third embodiment of the invention will now be described with reference to FIGS. 11 through 14.

FIGS. 11 through 14 show an arrangement in which a square tank 2A is mounted on a hull 1. Thus, a pair of rail members 29 (a modified construction of the previously described receiving member 16) extending in the direction of width of the ship are laid through connecting members 28 on the double bottom of the hull 1, while an anti-floating member 30 untouchedly extending between said rail members 29 has a bracket 31 attached to the lower end thereof opposed to the lower surfaces of said rail members 29. A pressure-resistant heat insulating element 32 is attached to either the upper surface of the bracket 31 or the lower surfaces of the rail members 29 so that they may engage each other through such pressure-resistant heat insulating element 32. In addition, the rail members etc. are provided in a plurality of pairs as viewed longitudinally of the ship. Alternatively the rail members 29 may be disposed on the longitudinally extending frame of the ship so as to extend longitudinally of the ship and may be provided in a plurality of pairs as viewed widthwise of the ship.

I claim:

1. A support device for mounting an independent tank in the hold of a ship wherein:

said independent tank includes a bottom plate forming a first support member horizontally secured to the tank;

a plate in said hold forming a second support member;

tank supporting means interposed between said first and second support members;

a receiving member carried by the ship structure;

an anti-floating member provided on and projecting from said first support member through said receiving member without touching the latter member; and an engagement section on the free end of said anti-floating member so as to engage said receiving member when the tank tends to float up.

2. A support device as set forth in claim 1, wherein said receiving member consists of a pair of rail members disposed above the level of said engagement section on opposite sides of said anti-floating member.

3. A support device as set forth in claim 2, wherein said rail members extend widthwise of the ship.

4. A support device as set forth in claim 1, wherein a pressure-resistant heat insulating material is attached to at least one of the surfaces of said engagement section and of the receiving member which said engagement section engages when the tank tends to float up.

5. A support device as set forth in claim 1, wherein said anti-floating member consists of a band-like plate member provided at its free end with an engagement surface perpendicular to the plate member.

* * * * *